US011819144B2

(12) United States Patent
Cerilli et al.

(10) Patent No.: US 11,819,144 B2
(45) Date of Patent: Nov. 21, 2023

(54) SYSTEM FOR A CONVERTIBLE BED

(71) Applicant: Darling June, PBC, Orange, CT (US)

(72) Inventors: Anna Cerilli, Orange, CT (US); Erica Jaffe, New York, NY (US)

(73) Assignee: Darling June, PBC, Orange, CT (US)

( * ) Notice: Subject to any disclaimer, the term of this patent is extended or adjusted under 35 U.S.C. 154(b) by 0 days.

(21) Appl. No.: 17/830,001

(22) Filed: Jun. 1, 2022

(65) Prior Publication Data

US 2022/0378222 A1 Dec. 1, 2022

Related U.S. Application Data

(60) Provisional application No. 63/195,440, filed on Jun. 1, 2021.

(51) Int. Cl.

| | |
|---|---|
| ***A47D 7/02*** | (2006.01) |
| ***A47D 7/01*** | (2006.01) |
| ***A47D 7/00*** | (2006.01) |
| ***A47C 21/08*** | (2006.01) |
| ***A47C 21/00*** | (2006.01) |

(52) U.S. Cl.

CPC ..... *A47D 7/02* (2013.01); *A47C 21/08* (2013.01); *A47D 7/01* (2013.01); *A47C 21/00* (2013.01); *A47D 7/00* (2013.01)

(58) Field of Classification Search

CPC ... A47D 7/02; A47D 7/01; A47D 7/00; A47C 21/08; A47C 21/00

USPC ..... 5/93.2, 93.1, 100, 425, 428, 430, 424

See application file for complete search history.

(56) References Cited

U.S. PATENT DOCUMENTS

| | | | | | |
|---|---|---|---|---|---|
| 2,059,240 | A * | 11/1936 | Johnston | A47D 7/00 | 182/20 |
| 2,857,604 | A * | 10/1958 | Shaw | A61G 7/0515 | 5/428 |
| 4,653,129 | A * | 3/1987 | Kuck | A61G 7/0519 | 5/430 |
| 4,811,436 | A * | 3/1989 | Schwartz | A47D 9/012 | 5/100 |
| 4,839,933 | A * | 6/1989 | Plewright | A61G 7/1046 | 5/430 |
| 5,129,117 | A * | 7/1992 | Celestina | A61G 7/0514 | 5/430 |
| 5,745,936 | A * | 5/1998 | Van McCutchen | A61G 7/051 | 5/430 |
| 6,374,437 | B1 * | 4/2002 | Voelker | A61G 7/051 | 5/426 |
| 6,446,283 | B1 * | 9/2002 | Heimbrock | A61G 7/00 | 5/430 |
| 6,640,361 | B2 * | 11/2003 | Heimbrock | A61G 7/0516 | 5/430 |
| 6,751,815 | B2 * | 6/2004 | Heimbrock | A61G 7/00 | 5/424 |

(Continued)

*Primary Examiner* — Robert G Santos
(74) *Attorney, Agent, or Firm* — Stephen J. Kenny; Vincenzo DiMonaco; Foley Hoag LLP

(57) ABSTRACT

A convertible bed with a moveable sidewall that can collapse from an upright and locked position to be stored underneath a mattress of the bed. The moveable wall includes pins that travel along sliding tracks that have J-shaped slots underneath the mattress during the conversion from open to closed positions. The moveable sidewall is lifted upward and inwardly to disengage the lock and the folds outwardly and downwardly to slide under the mattress for storage.

20 Claims, 22 Drawing Sheets

(56) References Cited

U.S. PATENT DOCUMENTS

| | | | | |
|---|---|---|---|---|
| 6,983,496 | B1 * | 1/2006 | Hernandez | A47D 7/02 5/100 |
| 7,076,817 | B1 * | 7/2006 | Garver | A61G 7/0507 425/430 |
| 10,980,688 | B1 * | 4/2021 | Albahkali | A61G 7/0506 |
| 2003/0019035 | A1 * | 1/2003 | Heimbrock | A61G 7/0509 5/428 |
| 2004/0025253 | A1 * | 2/2004 | Heimbrock | A61G 1/0243 5/425 |
| 2006/0000017 | A1 * | 1/2006 | Hernandez | A47D 15/008 5/100 |
| 2022/0378222 | A1 * | 12/2022 | Cerilli | A47D 7/02 |

* cited by examiner

SYSTEM FOR A CONVERTIBLE BED

CROSS-REFERENCE TO RELATED APPLICATIONS

This application claims the benefit of U.S. Provisional Patent Application No. 63/195,440 filed on Jun. 1, 2021 and titled "Convertible Bed", the entirety of which is incorporated by reference herein.

BACKGROUND OF THE DISCLOSED SUBJECT MATTER

Field of the Disclosed Subject Matter

The disclosed subject matter relates to an apparatus and system for enhanced and supported youth sleeping. Particularly, the present disclosed subject matter is directed towards a convertible apparatus that provides safety and decreased stimulation during sleep and nighttime hours, particularly for special needs children and also facilitates ingress/egress for parents or caregivers.

Description of Related Art

Many different methods and systems are available for assisting children in sleeping, including cribs, basinets, and beds. These can include frames to surround all sides or basinets, which are similar to a basket that is suspended and moves easily to be near parents when sleeping. The frames are usually on four sides to provide enhanced security and support.

To enter or exit the bed, a sidewall can be partially retracted or lowered, however the retracted sidewall remains in an upright position and presents a hurdle in which the child must climb over, or the parent must lift the child over; either scenario presenting a risk of injury. Such conventional systems generally have been considered satisfactory for their intended purpose; however, these typically require the child to have sufficient strength and coordination to support getting in and out of bed during the day or night. Moreover, traditional sleeping cribs are not necessarily designed for children getting in and out that are handicapped or have mobility problems. These systems are typically designed for infants and/or toddlers and do not address the needs of school age children or those with developmental or physical needs. The configuration of most beds for children with special needs have bars or are fully enclosed with "observation-like" windows. There thus remains a need for an apparatus, which facilitates individual (e.g. parents) ease of getting in and out of bed and sleeping without injuring a child throughout the night.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a convertible bed apparatus including a base; a skirt comprising a plurality of lower sidewalls disposed below the base, a plurality of sidewalls disposed above the base, and at least one moveable sidewall, the movable sidewall having a first upright position, and a second retracted position disposed under at least a portion of the base; wherein the movable sidewall is displaced along a sliding track disposed in the skirt, the sliding track configured with a J-shape which includes a first portion aligned with the sliding track, a second portion oriented at an acute angle with respect to the first portion, and a third portion oriented vertically.

In some embodiments the first pin is retained in the latch due to gravity. In some embodiments the movable sidewall is retained in the track configured with a J-shape at the lowest point of the track while in the retracted position due to gravity. In some embodiments the latch returns to the locked position after disengagement of the first pin. In some embodiments, the movable sidewall further comprises vertical slats. In some embodiments, the movable sidewall comprises foldable slats configured to rotate downward when the movable sidewall is in the retracted position to support the weight of the movable sidewall. In some embodiments, the movable sidewall is configured to be stable in an intermediary position wherein the foldable slates support the weight of the movable sidewall while in the intermediary position partially under the base. In some embodiments, the movable sidewall is configured to create a stepping area when in the retracted position configured to assist a person getting into the convertible bed apparatus. In some embodiments, the latch is configured to allow the pin to pass by and deflect it in one direction and lock the movable sidewall when in the upright position.

In some embodiments, a first pin can be included on the movable sidewall that can be unlocked to allow the movable sidewall to displace between the first and second positions. In some embodiments, the first pin is disengaged by opening a latch. In some embodiments, the first pin has a plurality of distinct diameters. In some embodiments, the first pin disposed at a top of the moveable sidewall and a latch disposed at a top of an adjacent sidewall. In some embodiments, a second pin is included and disposed at a bottom of the moveable sidewall. In some embodiments, the second pin is disposed in the rear of the sliding track when the movable sidewall is in the retracted position. In some embodiments, the second pin is disposed in the third portion of the sliding track when the movable sidewall is in the upright position. In some embodiments, the first pin is disposed below the J-shape portion of the sliding track when the movable sidewall is in the retracted position. In some embodiments, the skirt includes a recess, the recess disposed below the J-shaped track and located on a side of the skirt that coincides with the moveable wall. In some embodiments, the first pin is received within the recess when the movable sidewall is in the retracted position. In some embodiments, the movable sidewall has a greater height than an adjacent sidewall. In some embodiments, the first pin has a first diameter defining an exterior surface configured to match a first radius of curvature of the latch, and a second diameter defining an exterior surface configured to match a first radius of curvature of the latch.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION

Reference will now be made in detail to exemplary embodiments of the disclosed subject matter, an example of which is illustrated in the accompanying drawings. The method and corresponding steps of the disclosed subject matter will be described in conjunction with the detailed description of the system.

Figure 1:
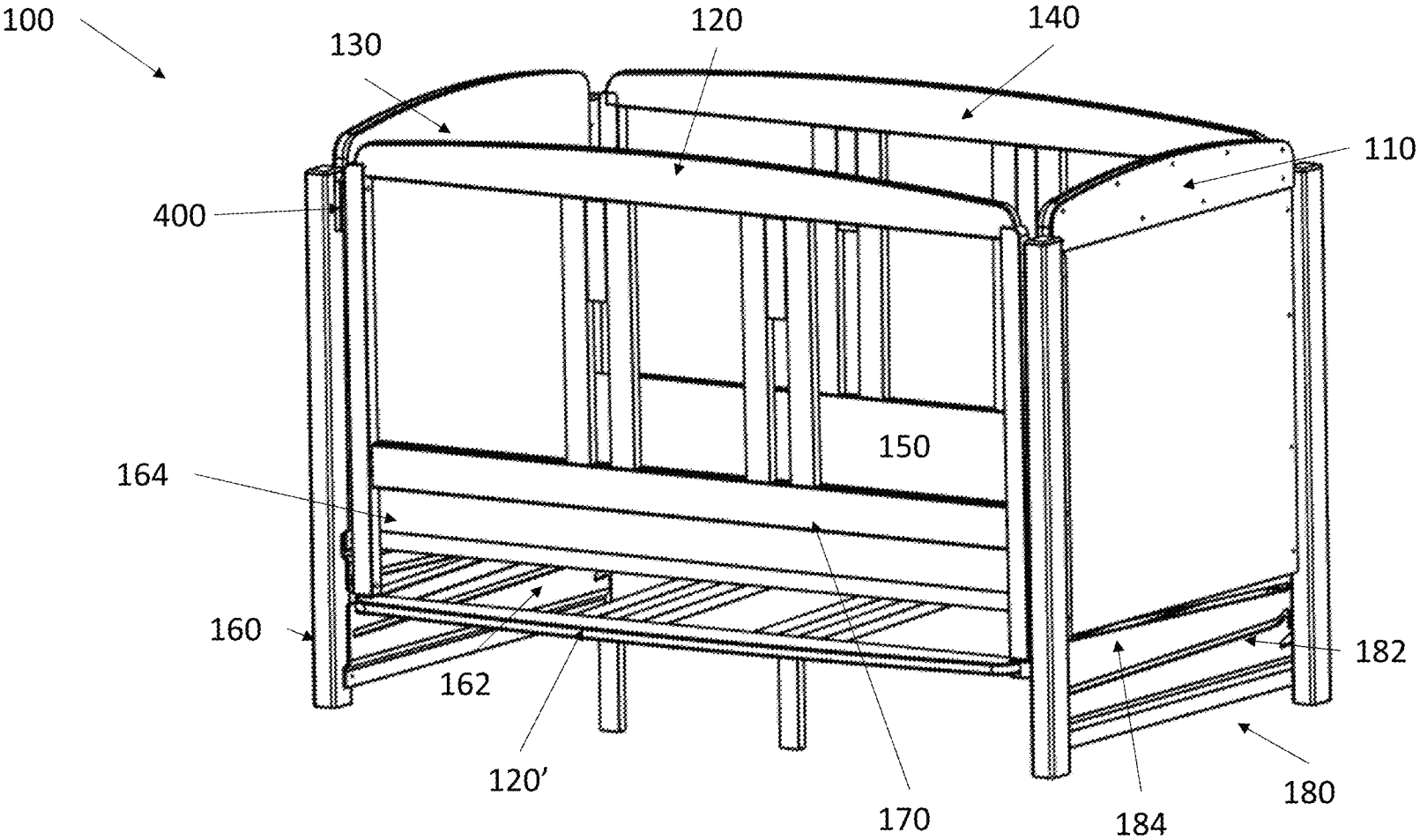
FIG. 1 is a schematic representation of a front perspective view of the children's convertible bed apparatus, in accordance with the disclosed subject matter.

The methods and systems presented herein may be used for assisting and protecting children while in bed. The disclosed subject matter is particularly suited for providing a sleeping solution for children who cannot sleep in a typical child or adult bed. Two different configurations are available between an open and closed bed apparatus. When in the open configuration it allows the sidewall to fit under the mattress for easy storage. When in the closed configuration, the child is protected from accidental or undesired removal and can sleep in a protected space. For purpose of explanation and illustration, and not limitation, an exemplary embodiment of the system in accordance with the disclosed subject matter is shown in FIG. 1 and is designated generally by reference character 100. Similar reference numerals (differentiated by the leading numeral) may be provided among the various views and Figures presented herein to denote functionally corresponding, but not necessarily identical structures.

As shown in FIG. 1, the children's convertible bed apparatus 100 generally includes a base 150, four-side railings with upper frame edges 110, 120, 130, and 140, as well as lower sidewalls 160 and 180, and lower support railing 170 (which is parallel to upper edge 120 of the first side railing). Base 150 may additionally or alternatively be a mattress portion of the system or a portion on top of which a mattress, pad, or other component may be disposed on and supported by, in embodiments. Note, although the term "railing" is used and a hollow railing frame is shown in some figures, it is to be understood that a variety of structures, e.g. sidewalls, panels, screens, etc. can be employed within the scope of the present disclosure. FIG. 1 shows all railings in the upright position, while also showing (e.g. superimposing) the position of side railing 120 when it is in the retracted/collapsed/stored position (i.e. where the top edge, denoted by reference numeral 120', is shown in the stored position) which is below the lower support railing 170. Lower sidewalls 160 and 180 include sliding track 182 for receiving a bottom of the (rear) convertible sidewall 140; only one sliding track 182 is visible in FIG. 1, with its mirror image being located in the opposite lower sidewall 160.

Still referring to FIG. 1, the bottom of the moveable railing 140 can have a pair of pins that project laterally outward from the railing which are sized to fit (and remain) within the sliding tracks 182 (i.e. one pin in lower sidewall 160, one pin in lower sidewall 180) during the entire range of motion of the railing 140. Similarly, a second sliding track 184 is included in the lower sidewalls 160, 180 that is configured to receive a similar pin at the bottom of (front) railing 120, and remain within the track 184 during the entire range of motion of railing 120. In other words, the bottoms of the moveable railings remain engaged with and retained within the slots 182, 184 during conversion between upright and collapsed (i.e. stored under the mattress) positions. Conversely, the top edges of the moveable railings can (temporarily) disengage from their neighboring structure to pivot or rotate outward and downward while the bottom of the sidewall translates within the tracks 182, 184.

With continued reference to FIG. 1, area 400 refers to where the pin locking mechanism is located, which will be described and shown in more detail in other figures. These locking mechanisms are located on an interior surface of railings 110, 130 and configured to receive a locking pin that projects outwardly from the moveable railings 120, 140. Accordingly, the moveable railings 120, 140 are sized with a lateral width that is less than the width of the fixed railings 110, 130 so that the moveable railings 120, 140 fit "within" the fixed sidewalls.

It is worth noting that in FIG. 1 and some following figures, the railings 110, 120, 130, and 140 are shown as struts for these perspective views. Solid or mesh paneling can be added to these railings to form sidewalls that retain the contents of the bed (e.g. child, toys, sheets, etc.) within the confines of the upright sidewalls. It should be noted that this solid or mesh paneling may include structural support to the upright sidewall as well as configured to be see-through such that the person inside the convertible bed may be observed through the mesh.

With continued reference to FIG. 1, in the exemplary embodiment shown, two side railings 120 and 140 are configured to be retractable to fit under the base 150 (e.g. in an overlapping manner in which the respective edges of each railing 120, 140 are stacked/aligned to minimize the storage space required). In some embodiments, only one of the two moveable railings 120, 140 can be collapsed and stored under the mattress at a given time. Additionally or alternatively, in some embodiments, both side railings 120 and 140 can be collapsed and stored underneath at the same time. In this configuration, railings 110 and 130 (which coincide with the child's head and foot position) are not retractable. Alternatively, the arrangement of the moveable sides can be swapped such that head and foot railings 110, 130 are retractable, while the side railings 120, 140 remain fixed in the upright position (this swapped configuration would require lower sidewalls 160, 180 to be relocated to extend longitudinally below the mattress).

Figure 2:
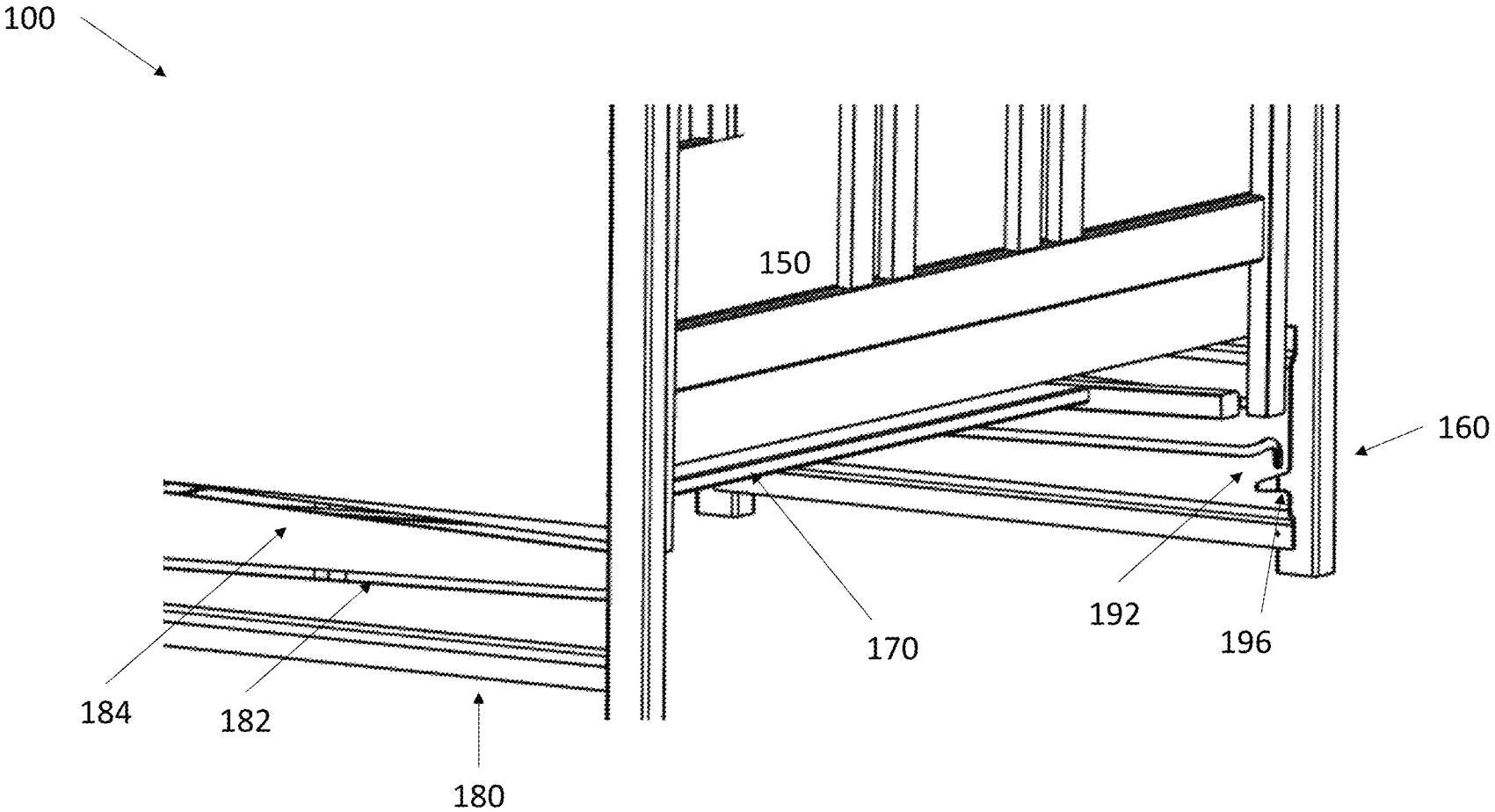
FIG. 2 is a partial back perspective view of the children's convertible bed apparatus.

Referring now to FIG. 2, a partial back perspective view of apparatus 100 is shown. The back view shows the distant railing 140 in the lowered/collapsed position with bottom portion of railing 140 out of view in this depiction, and the upper strut 190 of railing 140 in between the two lower sidewalls 160 and 180. The side struts of railing 140 include the pin that engages with the locking mechanism (described in further detail below) are shown positioned within notches 196 that are formed in the lower sidewalls 160, 180. In operation, when a user unlocks an upright railing and begins to transition the railing into the collapsed position, the lower pins of that railing remain in slot 184 and translate along the predefined path, while the top strut 190 swings outwardly (away from the mattress) and downward to bring top strut 190 to the same height as notch 196. As the lower pins travel (within the slots in the sidewalls 160, 180) to the opposite side of the bed, the top strut 190 is brought into engagement with the notch and securely retained therein.

The sliding track 182 on the lower sidewall 180 for example, shows the J-shape 192 at the end of the track. This J-shape design allows for lifting of either side railing 120 or 140 to latch into a locking position. Sliding track 184 is also shown on the lower sidewall 180. Here, the sliding tracks 162 and 164 that are a part of lower sidewall 160 are also visible. The pins on the bottom of the moveable railings 120, 140 slide (when converting the moveable railings to the upright position) within the linear portion of the sliding tracks 182, 184 until reaching the angled portion of the J-shape and then slide upward & forward at an angle such that the entire moveable railing 120, 140 is elevated to a height where it can engage with the locking mechanism 400 which is anchored on the adjacent, and fixed, railings 110, 130 (described in further detail below). As the locking mechanism 400 engages, the pins on the bottom pins are positioned about the apex of the J-shape. After the locking mechanism 400 engages, the pins slide downwardly into the "tail" of the J-shape, which can be positioned lower than the linear portion of the sliding tracks. Therefore the one or more pins are retained in the J-shape by gravity and cannot be moved back up the J-shape to bring the sidewalls to the upright position without the assistance of a user, such as a parent or user of the apparatus 100.

Figure 3:
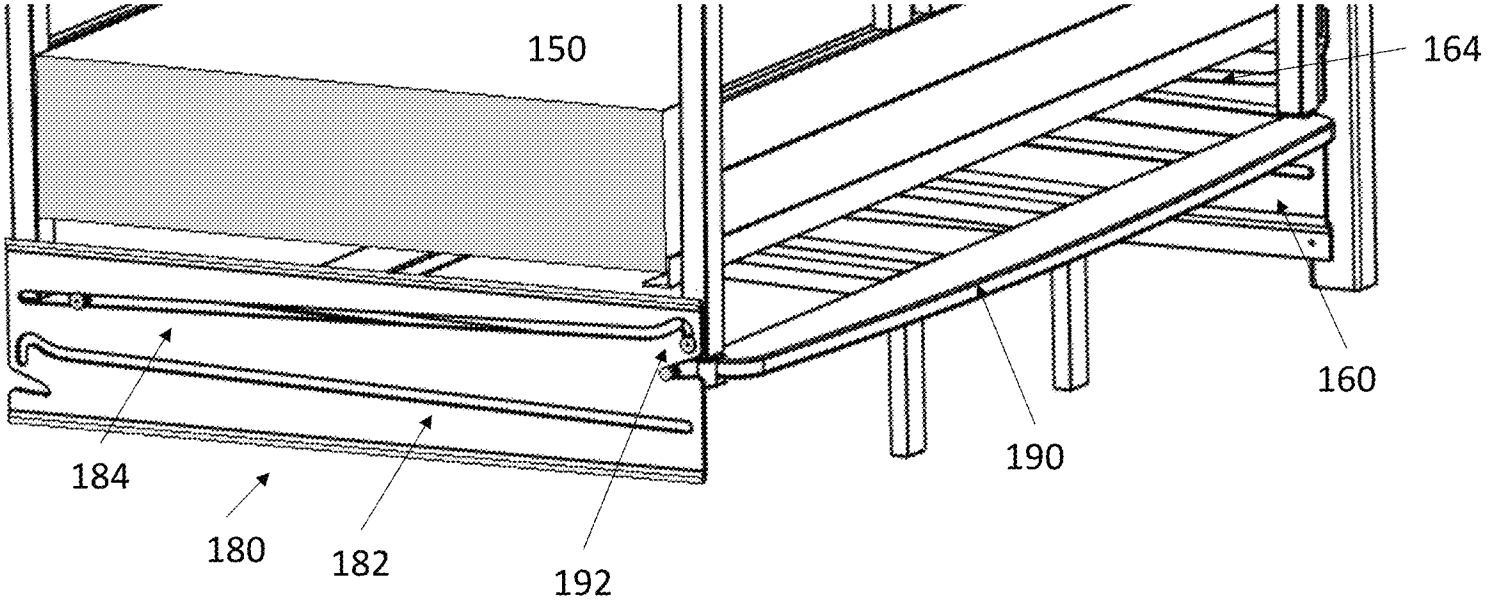
FIG. 3 is a partial left side perspective view of the children's convertible bed apparatus.

Referring now to FIG. 3, a view of apparatus 100 shows a similar partial rear perspective as FIG. 2. Here though, the differing heights of the sliding tracks 182 and 184 are more evident. Also, sliding track 164 of lower sidewall 160 are more visible. As previously expressed, the sliding tracks 182 and 184 may comprise a J-shape for retaining of the one or more pins. Also the sliding tracks may include one or more slopes configured to assist the stowing or raising of the sidewalls in a plurality of positions such as upright, retracted, or an intermediary position.

Figure 4:
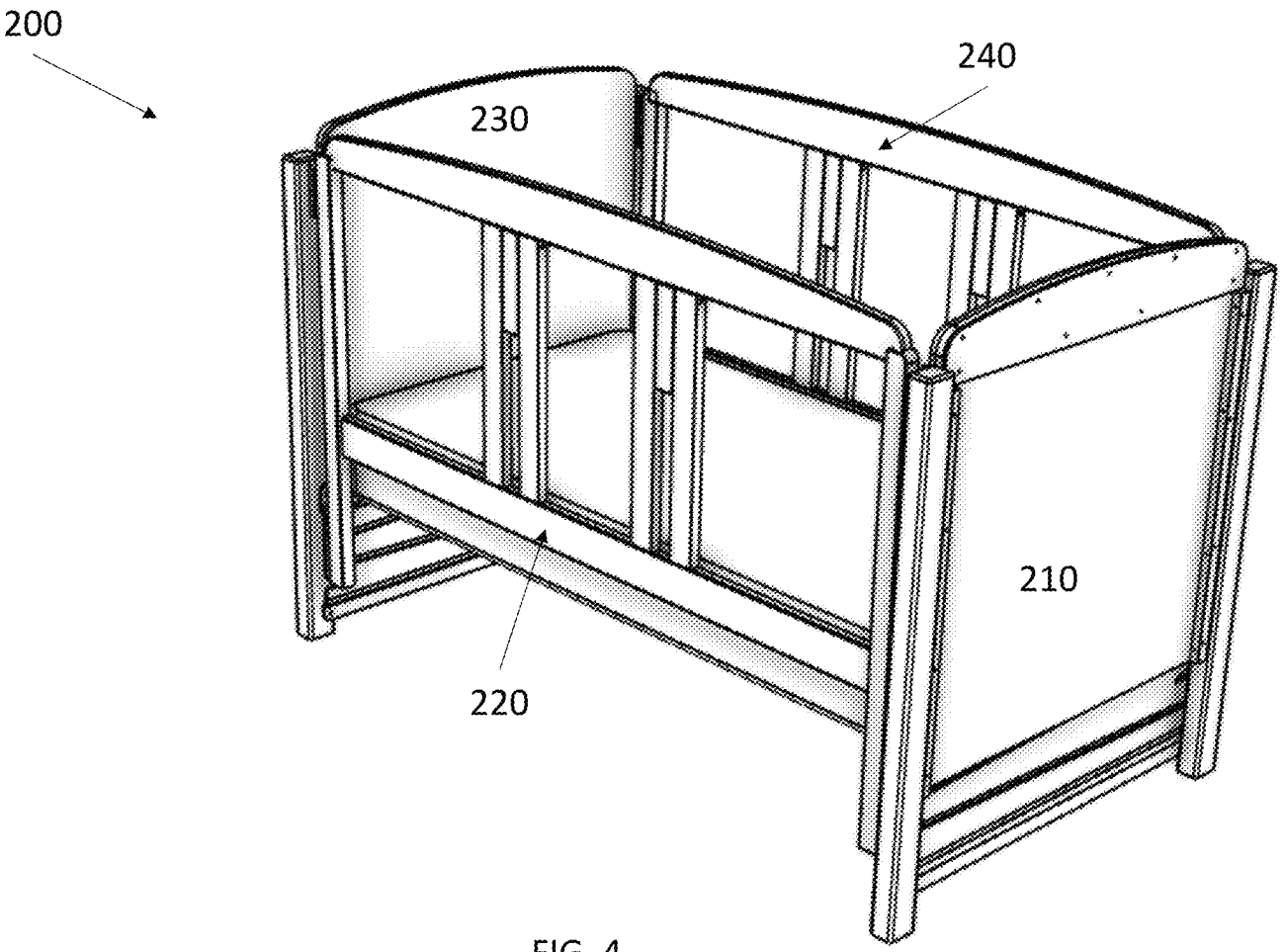
FIG. 4 is a perspective view of the closed retracted children's convertible bed apparatus.

Referring now to FIG. 4, there is a view that shows the children's convertible bed apparatus 200 in a fully closed position. The two sidewalls 220 and 240 are retractable/movable between upright and collapsed position. Retractable sidewalls 210 and 230 are fixed in an upright position. This allows the mattress to be used as a seat or a daybed. It also allows older children to get onto the mattress easier before the sidewalls 220 and 240 are raised into the upright position (as shown in the exemplary embodiment). In the closed position, a child can be safely positioned/retained on the mattress without risk of falling out.

Figure 5:
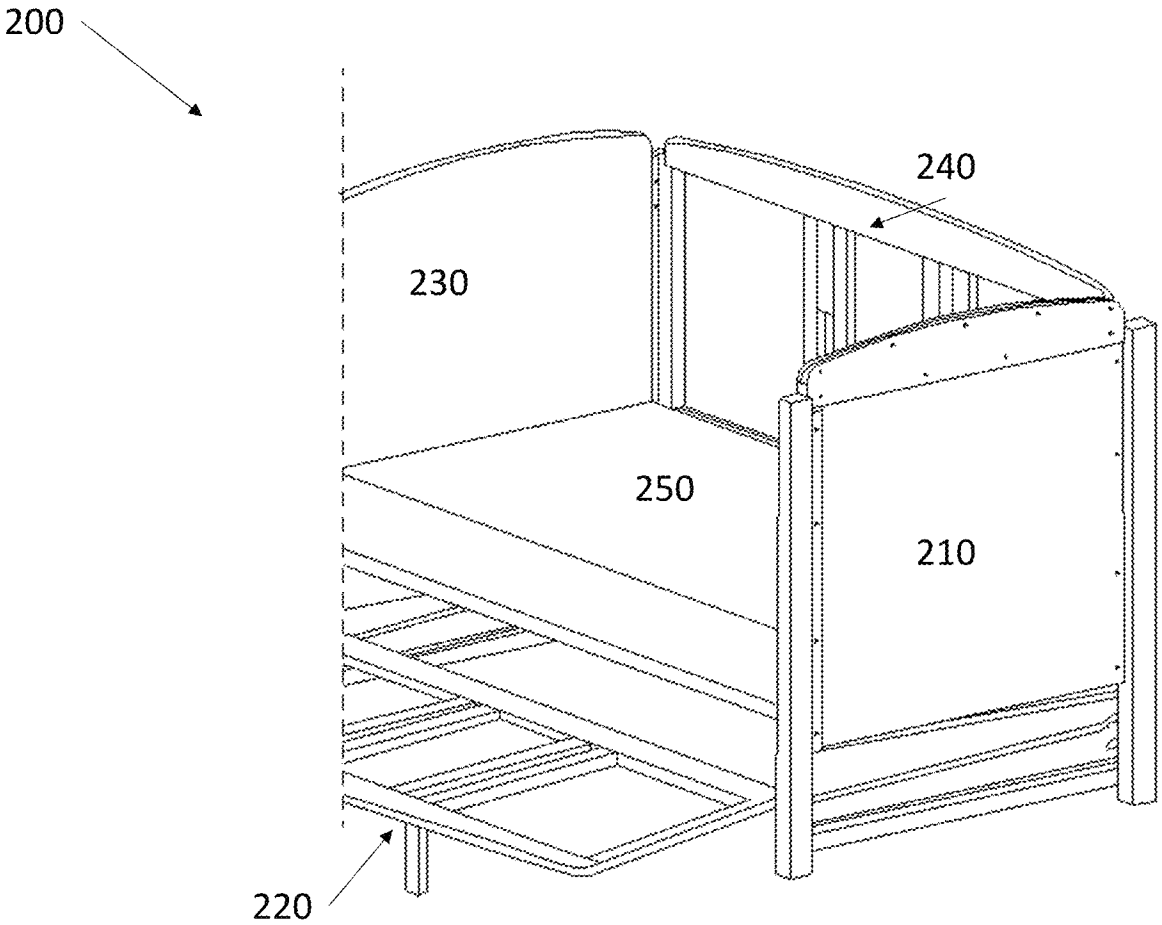
FIG. 5 is a perspective view of the children's convertible bed apparatus with the wall partially retracted.

Referring now to FIG. 5, there is a view that shows the children's convertible bed apparatus 200 with the retractable sidewall 220 in a partially-retracted position (approximately half of the sidewall 220 is retracted to be coplanar with the mattress, and inserted underneath the mattress). Sidewalls 210 and 230 are shown upright and not movable. Here, only one sidewall 220 is shown as retractable, but sidewall 240 can also be retracted. Also, the sliding tracks 162, 164, 182, 184 that receive the sidewall pins, can be positioned on an interior surface of the sidewalls such that these sliding tracks are not visible from an exterior view of the bed/crib. In some embodiments the first pin is retained in the latch due to gravity. In some embodiments the movable sidewall is retained in the track configured with a J-shape at the lowest point of the track while in the retracted position due to gravity. In some embodiments, the movable sidewall further includes vertical slats. In some embodiments these vertical slats can be configured to be foldable slats configured to rotate downward when the movable sidewall is in the retracted position to support the weight of the movable sidewall. The vertical slats would fold down and act as legs to support the movable sidewall for a plurality of purposes such as supporting a person getting into bed, or as a seat or platform. In some embodiments, the movable sidewall is configured to be stable in an intermediary position wherein the foldable slates support the weight of the movable sidewall while in the intermediary position partially under the base. In some embodiments, the movable sidewall is configured to create a stepping area when in the retracted position configured to assist a person getting into the convertible bed apparatus.

Figure 6:
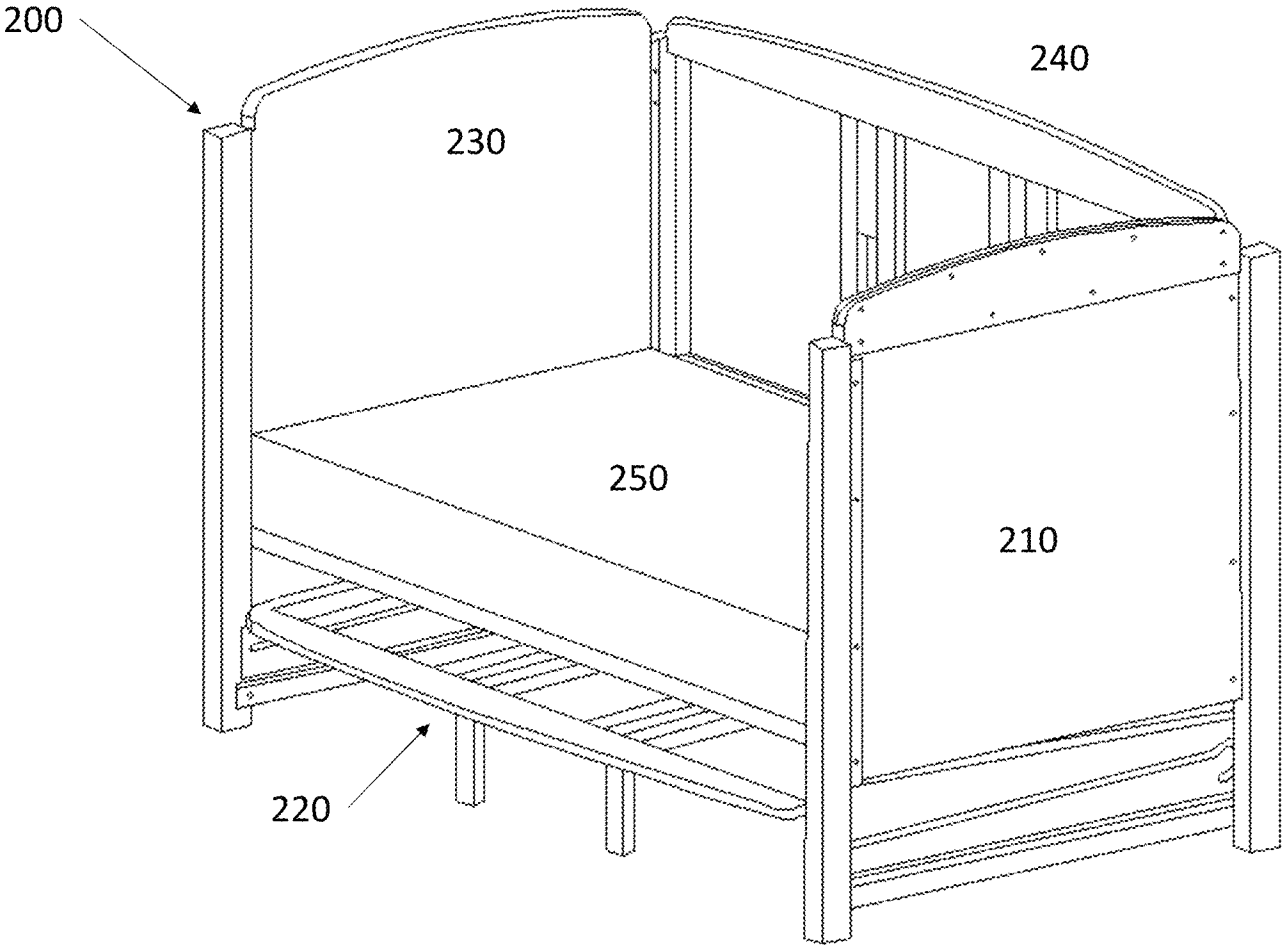
FIG. 6 is a perspective view of the children's convertible bed apparatus, showing the retracted open position of the sidewall.

Referring now to FIG. 6, there is a view that shows the children's convertible bed apparatus 200 in an open position. The retractable sidewall 220 is shown under the mattress 250 as to make the mattress 250 still useable. Again, sidewalls 210 and 230 are not movable and stay in the same upright position, as described earlier. Here, only one sidewall 220 is shown under the mattress, but it should be known in other embodiments, both side walls 220 and 240 can be under the mattress. Both sidewalls 220 and 240 utilize the pin mechanism system, which will be described in detail later.

Figure 7:
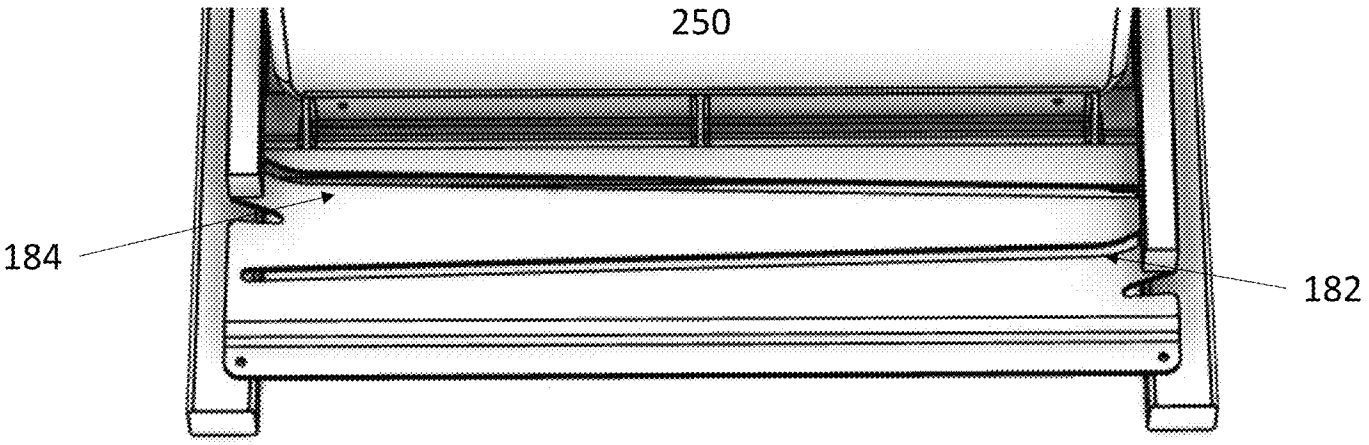
FIG. 7 is a side view of the children's convertible bed with the retracted open wall omitted for clarity sake.

A side perspective view is shown in FIG. 7, which shows how the retractable sidewall 220 is stowed underneath the mattress along a first sliding track 184 that is located above the sliding track 182 that receives sidewall 240. The retractable sidewalls are easily moveable along the sliding tracks to allow children to get in and out of the bed and to then have the retractable sidewall 220 moved outwardly and upwardly into the closed position for protection. Both sidewall 220 and 240 can be retracted at the same time, and in such scenarios, retractable sidewall 240 is below retractable sidewall 220.

Figure 8:
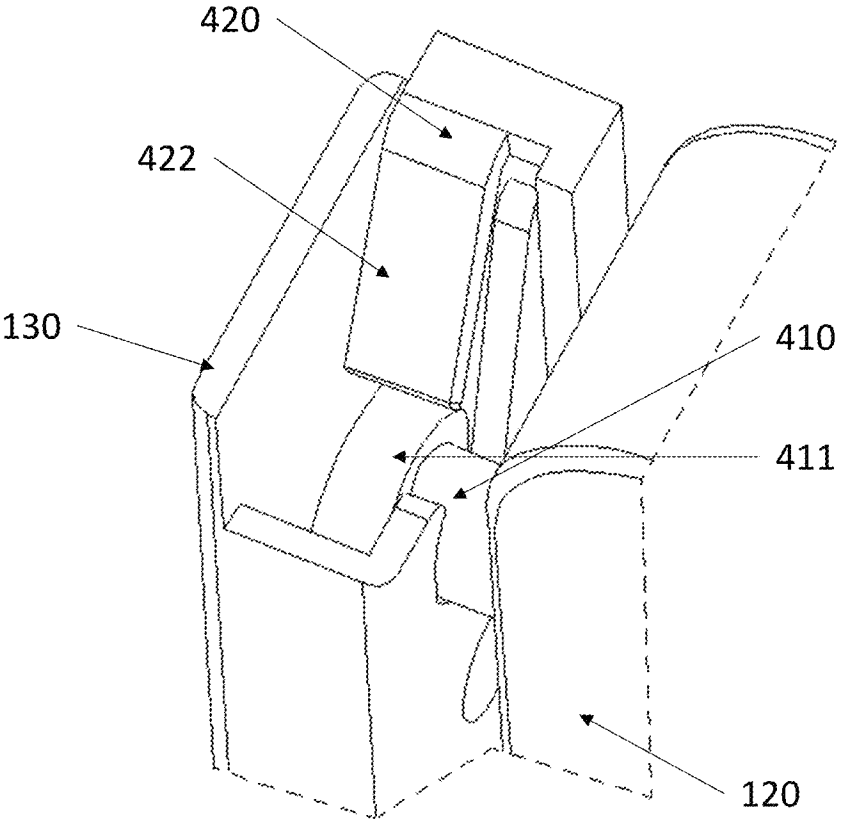
FIG. 8 is a view of the pin and clasp mechanism.

FIG. 8 is an exemplary embodiment of the pin locking mechanism 430. The pin 410 is locked into place and can then be unlocked (by lateral displacement of the secondary latching member 420 inwardly towards the mattress) to allow the sidewall to move between upright and collapsed (stored) positions. The pin 410 is fixedly attached directly to at least one of the moveable sidewalls (railing 120 in the embodiment shown). The secondary latch 420 is attached to the upright strut of the adjacent sidewall/railing that remains in a fixed position (railing 130 in the embodiment shown). The secondary latch 420 may include one or more cutouts that include partially encapsulating geometry configured to prevent the pin from moving in any undesired positions. To move the sidewall 120, the secondary latch 420 is released/displaced laterally and then the sidewall 120 is pulled up once the pin 410 disengages. The sidewall 120 is then pulled up and slightly outwardly, away from the mattress, which brings the pins on the bottom of that sidewall 120 up the J-shaped slot of the sliding tracks 182, 184, as described above.

Referring again to FIG. 8, the secondary latch 420 can engage with the pin 410 wherein the surface of the latch mechanism, which may be a concave surface of the latch mechanism engages a larger diameter portion 411 of pin 410. This allows for automatically pushing the latch out of the way to lock the retractable sidewall 220 into place. One can also use their thumb and press the handle portion 422 to unlatch the pin 410 and move the retractable sidewall 220. The portion of latch 422 may include a non-linear contour of the secondary latch 420 engages pin 410. Any portion of the latch and any portion of the pin may engage, according to embodiments. A smaller diameter of the pin may be used to retain the pin in the locked positon.

Figure 9:
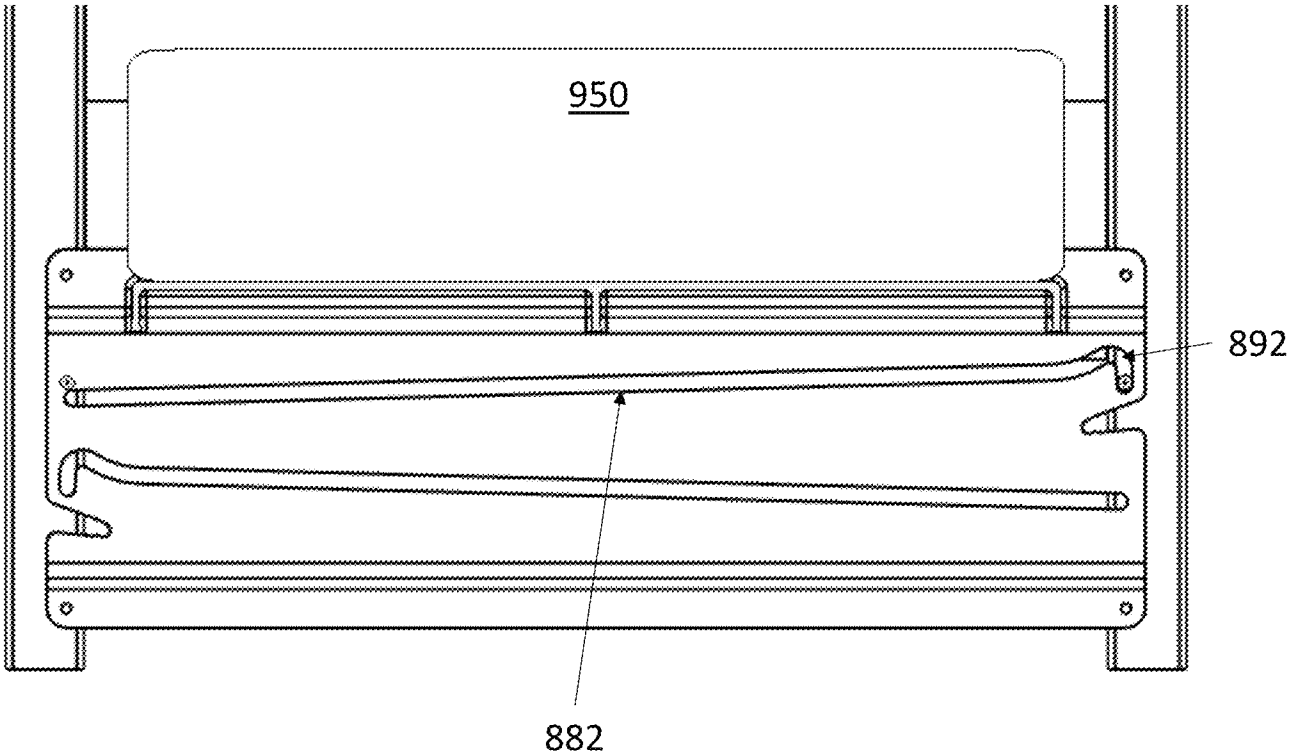
FIG. 9 is a side view of the convertible bed track mechanism.

A closer view of the J shape part of the track 892 is shown in FIG. 9. The J shape 892 of the sliding track 882 is what allows the movable sidewall 220 to move into an open and closed position. This J shape allows for lifting (i.e. vertical displacement) of the retractable sidewall 220 into a position to be able to lock the wall into place. This shape also makes for an easier lift and slide of the sidewall 220 between collapsed and upright positions. The shape of the secondary latch 420 and pin 410 is at a certain angle, i.e. requires an upward/inward force to be applied (from perspective of child within the bed/crib) which makes it harder for children (who lack the upper arm strength, coordination and dexterity) to lift the movable wall between the open and closed position.

Any angle that requires lifting the sidewall 220 back towards the interior of the mattress is within the scope of the disclosure, but for purpose of illustration and not limitation, in an exemplary embodiment the angle is between approximately 2-5 degrees from the vertical. This initial upward/inward force, at the aforementioned angle, disengages the secondary latch 420 from the pin 410. Thereafter, the sidewall 220 can be lifted from the outside (e.g. by an adult positioned external to the bed/crib) to its highest point (so that the pins in the bottom of that elevated sidewall reside at the apex of the J-shaped slot), the sidewall is then pushed inwardly (toward the interior of the mattress), e.g., with the adult's shin, at the bottom of the sidewall 220 to allow the bottom of the sidewall to slide down the angled portion of the J-shaped slot towards the middle of the bed/crib. These pins at the bottom of the retractable sidewall 220 serve as the pivot point or fulcrum (so that the top edge of sidewall 220 rotates outwardly form the mattress) and are located below the mattress, and in some embodiments below the remaining sidewalls.

Figure 10:
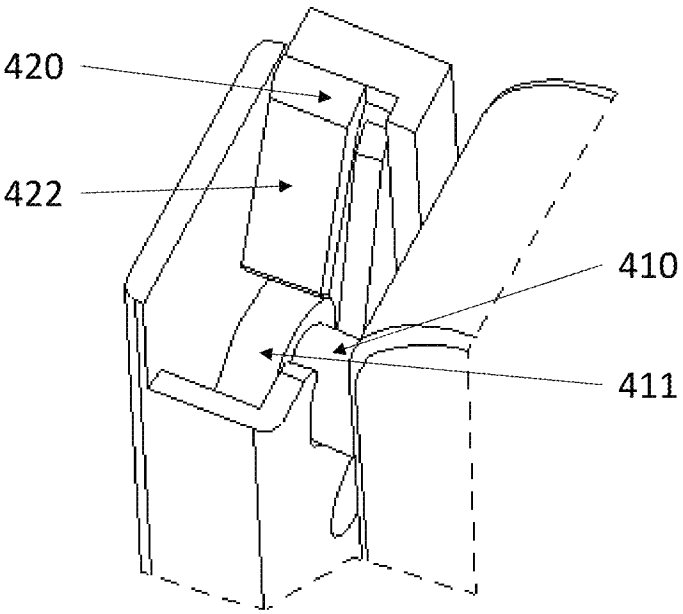
FIG. 10 is a view of the latch of the sidewall.

The pin 410 of FIG. 10 is shown when the retractable panel is in the upright, or closed position. A secondary latch 420 is also present, and in (releasable) locking engagement with the pin to prevent the movable sidewall 220 being inadvertently lowered. The secondary latch 420 may include a surface 422 with a complimentary contour to the pin (e.g. arcuate/concave) and has a handle (or lever) portion 422 that extends a height (e.g. approximately 2-5 inches) above the pin 410 when in the locked configuration, as shown. The handle/lever 422 can be used to disengage the locking mechanism and the pin 410. After a sidewall is unlocked, it can be pulled outwards to fully start the stowing process.

Figure 11:
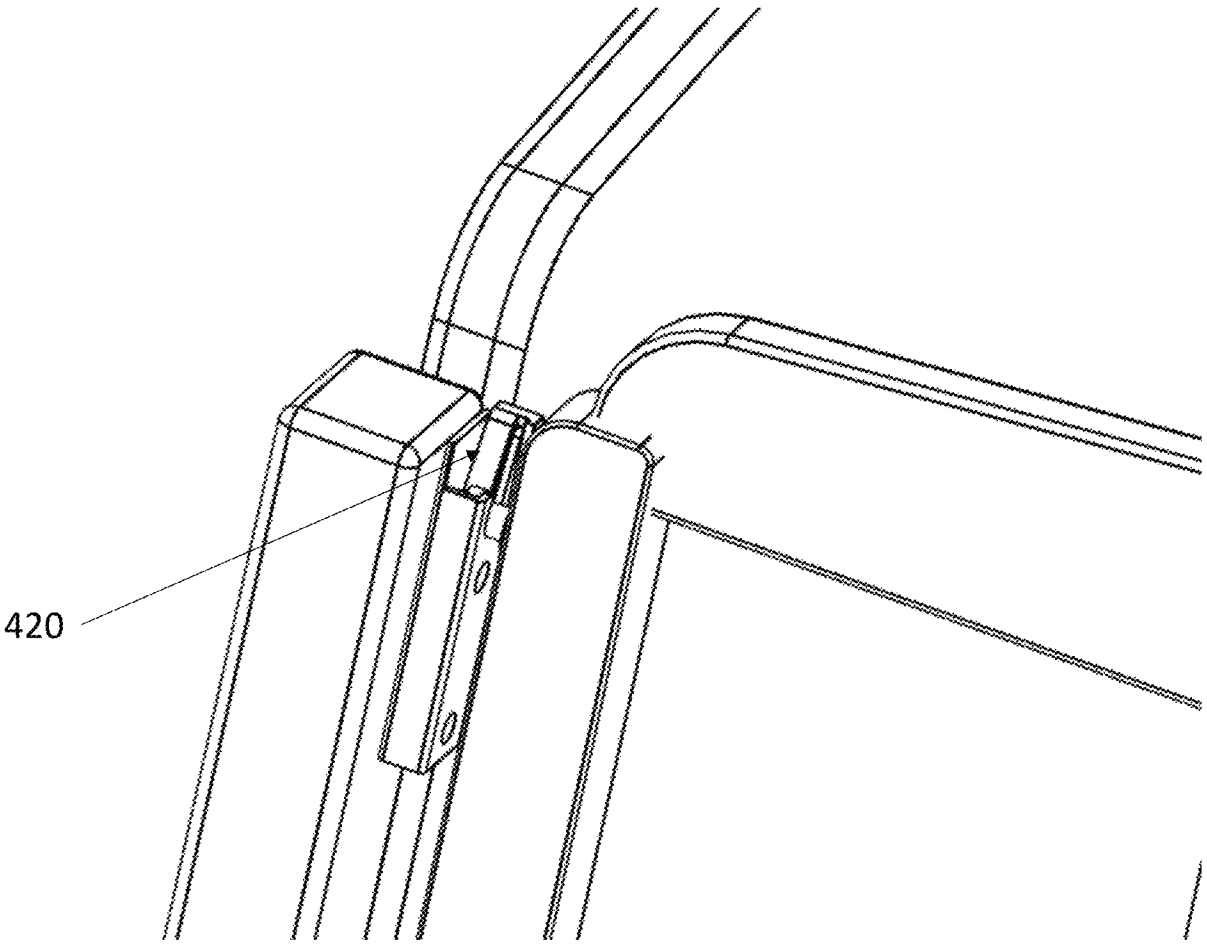
FIG. 11 is a view of the secondary latch mechanism.

In FIG. 11, the secondary latch 420 is further shown. Here, secondary latch mechanism 420 allows the sidewall to lock into position effectively creating a two-stage lock system for further safety. Latch mechanism 420 may include geometry configured to capture the one or more pins from moving out of the locked position by movement of the bed. Secondary latch 420 may include geometry configured to retain the latch in a slot or track wherein the user would have to manipulate the pin through the track to move the sidewall.

Figure 12A:
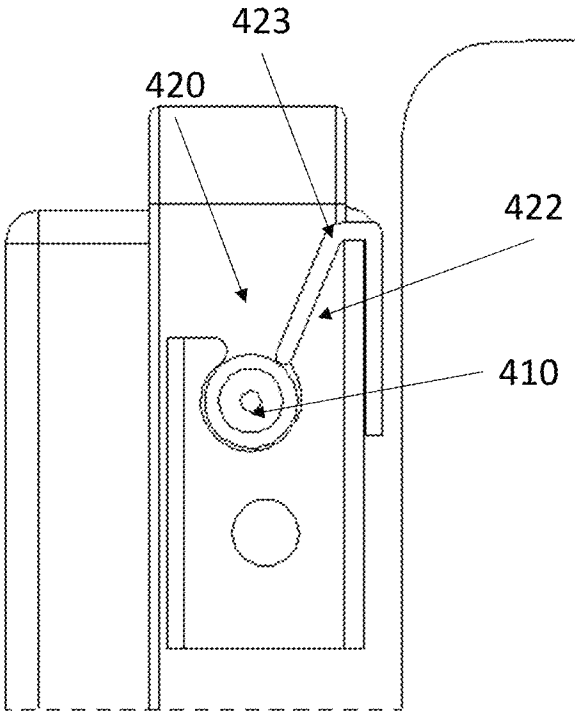
FIGS. 12A-12E is multiple side views of the interior of the latch of the sidewall.
Figure 13:
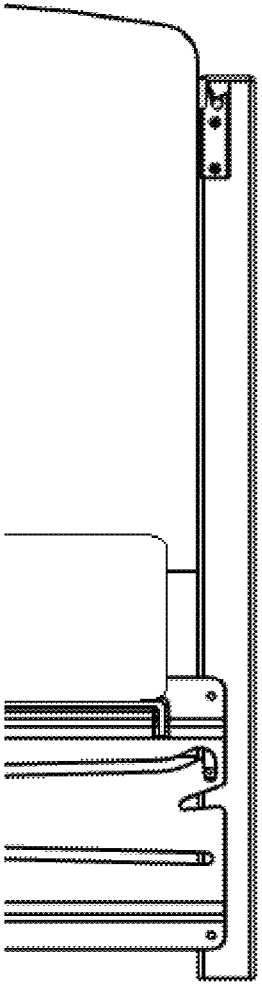
FIG. 13 is a view of the sidewall in the latched position.

Referring now to FIG. 12A, in some embodiments the secondary latch 420 extends down the vertical edge of the (stationary) sidewall. The latch mechanism can be formed with a point of inflection 423 at approximately the top of the stationary wall, wrapping above such that it is disposed on the outside portion of the stationary wall. The inflection point may be approximately at the midpoint thereof. The inflection point 423 biases the latch mechanism 420 to engage and lock the pin 410. In operation, when an adult is locking the moveable sidewall in the upright position the pin 410 slides along (down) the ramp portion 422 which deflects the latch mechanism towards the interior/mattress (or left in the perspective shown in FIG. 13). Once the pin 410 passes the apex of ramp 422, the biasing force generated by inflection point 423 urges the latch mechanism surfaces 422 to engage and lock pin 410.

Figure 12B:
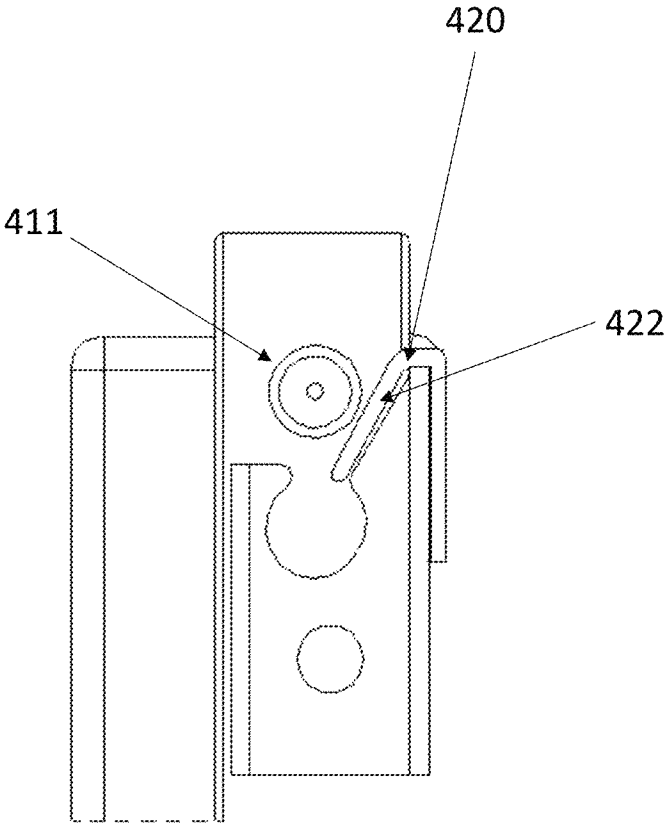
Figure 12C:
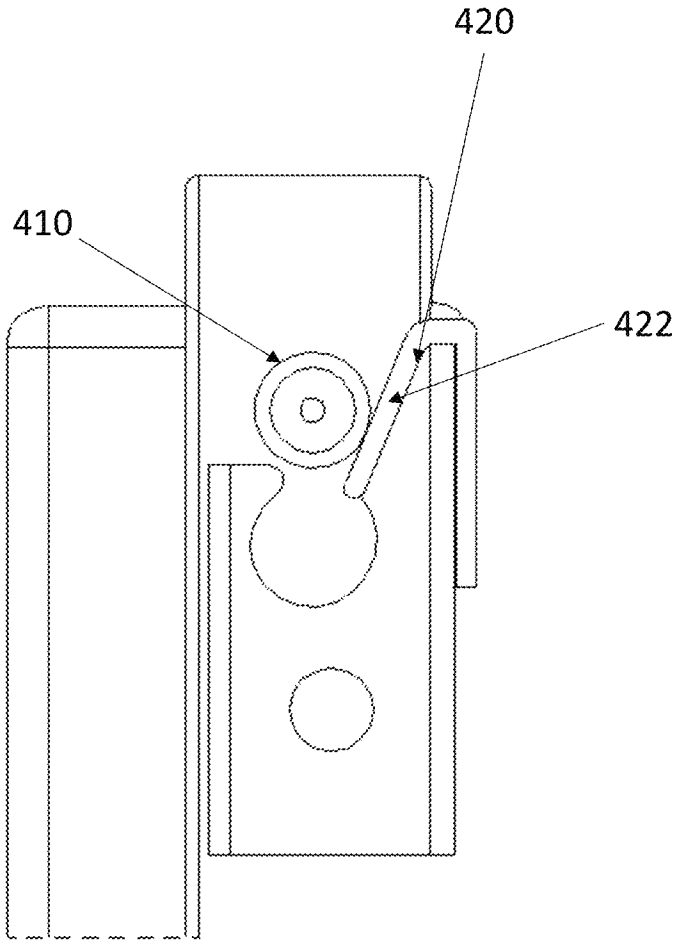

FIG. 12B further shows the secondary latch 420 when the adult begins the locking process with the secondary latch 420 engaged with the pin 410 and pushes the secondary latch 420 rearwards (rightwards, as depicted). In operation, the pin 410 moves down, with pin portion 411 pushing against the latch surface 422 as seen in FIG. 12C. The small diameter of pin may engage and push the latch portion 422 further back after the pin 410 descends below the latch 422. In embodiments, the pin may include more than one diameter which contacts and engages portions of the latch, according to embodiments. The latch then snaps back over the pin with the first latch portion 422 residing over the larger diameter pin portion 410. According to embodiments including more than one pin diameter may be locked in by corresponding latch mechanisms configured to lock the corresponding pin. The frictional forces between these mating/arcuate surfaces retains the sidewall in the upright position unless/until the latch is disengaged by an adult (as described above). For example and without limitation, gravity may assist in keeping the pin 410 locked under latching surface 422, retaining it therein.

In accordance with another aspect of this disclosure, the sidewall 220 can be retracted with a one-handed, or two-handed operation. For example, in a single-step (one-handed) operation, when the latch 420 is disengaged, a spring can push the sidewall 220 up enough to keep the secondary latch 420 from re-engaging with the pin 410. With the latch (maintained in the disengaged position), the user could then life the sidewall 220 with one hand and retract as previously discussed.

Figure 12D:
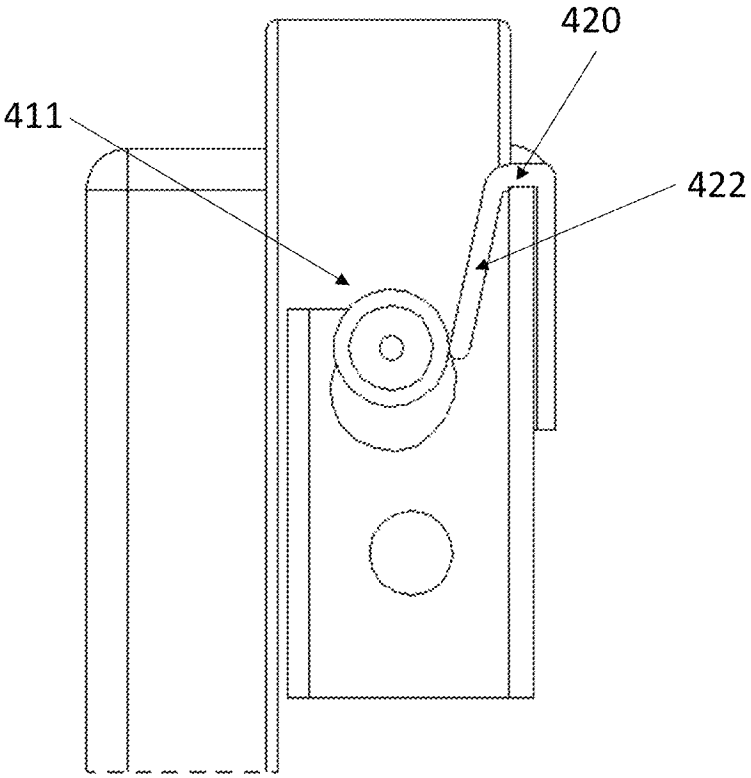
Figure 12E:
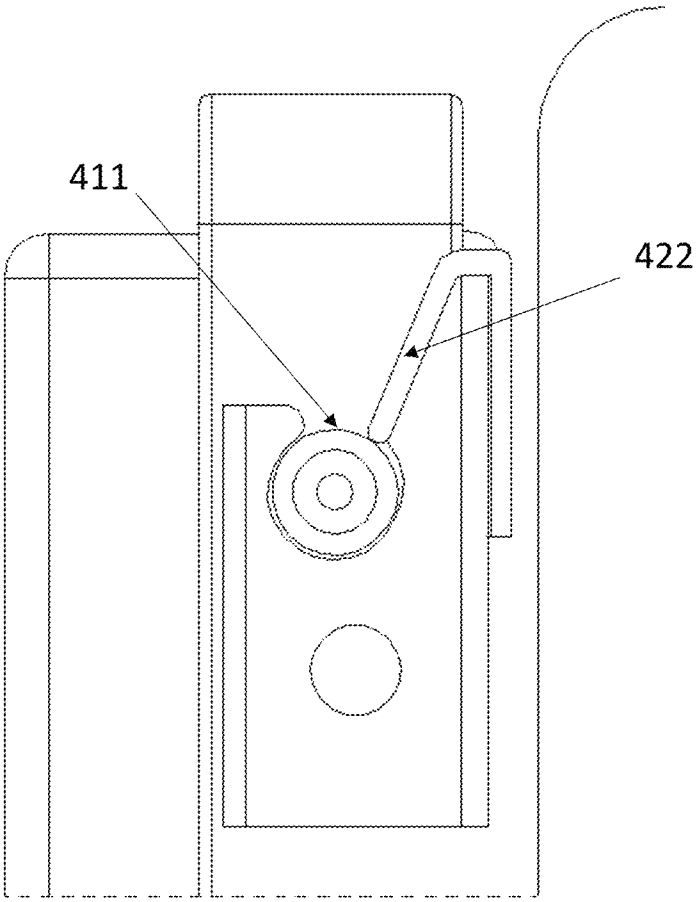

Additional views of the secondary latch 420 is shown in FIGS. 12A-E with the pin 410 shown at various stages in the engagement, or locking, process. FIG. 12A shows an isolated view of the moveable sidewall in the locked (left hand side) and unlocked (right hand side) positions. Note the location of the pin at the bottom of the panel 220 residing at the bottom of the J-shaped slot in the locked (left hand side) illustration and at the apex of the J-shaped slot in the unlocked (right hand side) illustration. FIG. 12B shows the initial stages of locking where the pin 410 on the moveable sidewall approaches the secondary latch mechanism 420 on the adjacent/fixed sidewall, and FIG. 12C shows the largest diameter portion 413 of the pin engaging the upper portion of the secondary latch 420 to displace the latch backwards toward the interior of the bed/crib. FIG. 12D shows the pin 410 as it approaches the apex of the latching mechanism 422, and FIG. 12E shows the pin 410 in the final, locked position with its diameter portion 411 engaged with latch portion 422.

Figure 14:
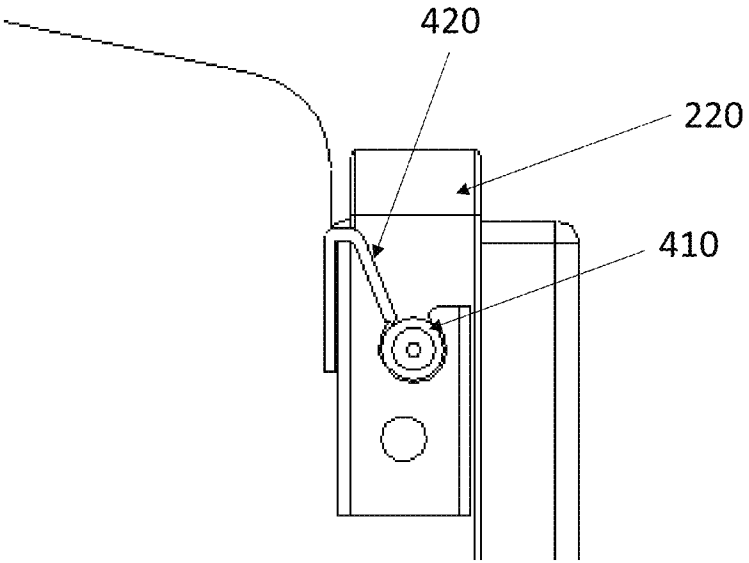
FIG. 14 is a view of the locking pin mechanism.

FIG. 14 shows a side view of the pin 410 and the secondary latch 420, in the locked position, illustrating the (reverse) angle on the slot where the pin 410 is inserted within receiving channel of the stationary sidewall. This specific angle would require a child to unlatch the secondary latch 420 by pulling the retractable sidewall 220 inwards (to disengage secondary latch 420) while at the same time lifting the retractable sidewall 220 upwards (to clear the pin from the latch which is biased to close) a distance of several inches. This is impossible or at least difficult for the child, due to the weight of the retractable sidewall 220 and makes it harder for children to lift the retractable sidewall 210.

Figure 15A:
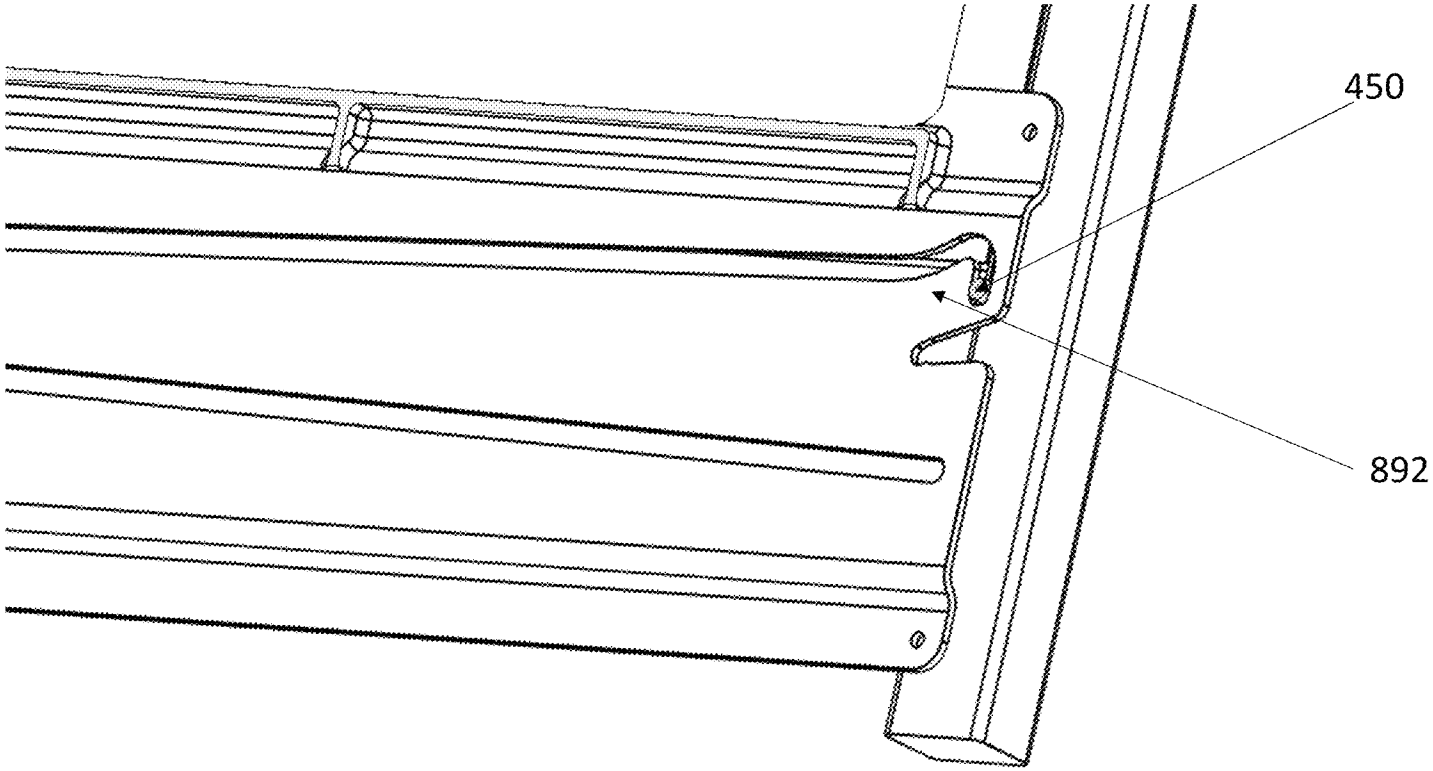
FIG. 15A is a view of the side panel of the pin in the locked position.
Figure 15B:
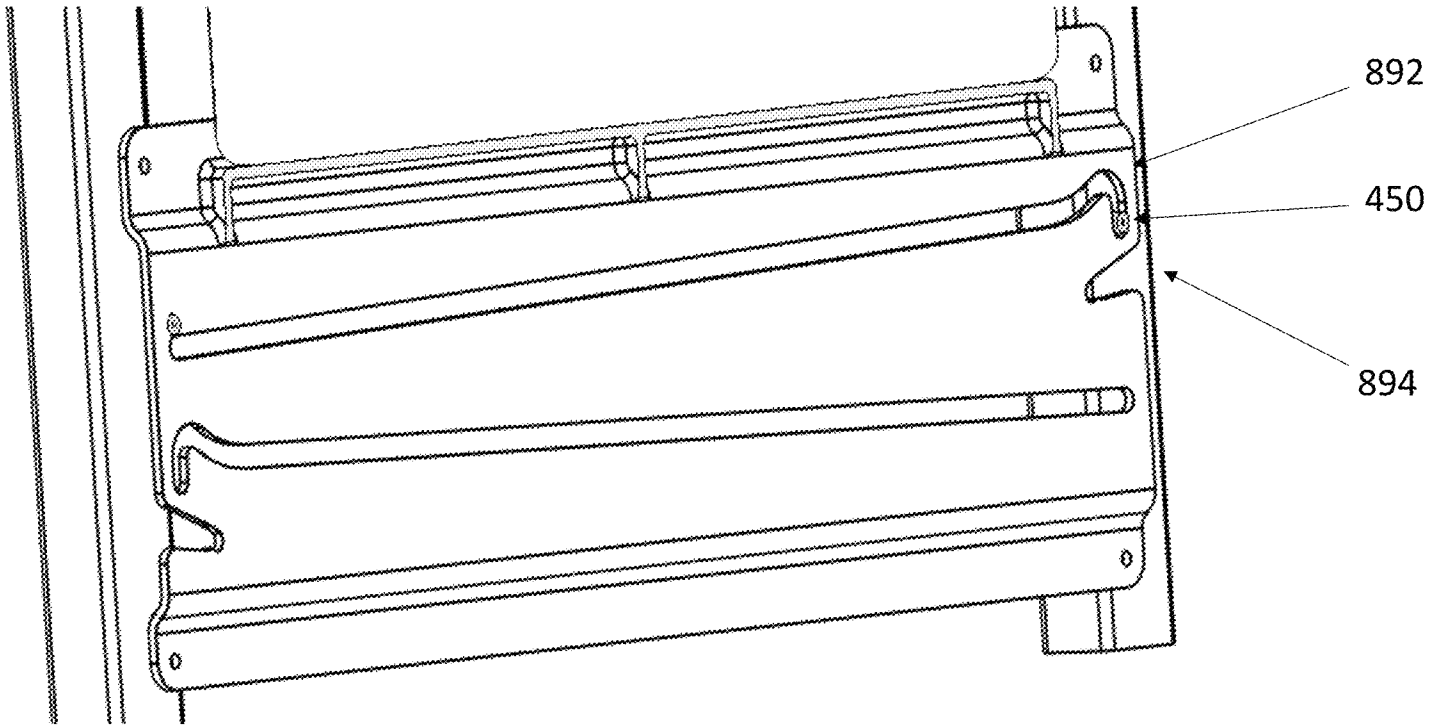
FIG. 15B is a view of the sidewall in the retracted position.

FIG. 15A illustrates the lower pin 450 in the locked position along the J-shape of the track (i.e. at the end of the J-shape and below the horizontal portion of track 892), and FIG. 15B illustrate the lower pin 450 in the unlocked position along the J-shape of the track (i.e. at the opposing end of the J-shape track 892). In FIG. 15A, when the retractable sidewall 220 is in the locked position, or upright position, the pin 410 (which is located at the top of the moveable sidewall) is not visible. In FIG. 15B, when the retractable sidewall 220 is in the stowed position, the pin 410 is at the section 894 of the track below the J-shape 892 (and thus below the remainder of track 892 as well); lower pin 450 is shown in the distal end of the track 892. Thus, lower pin 450 moves to the distal end of the track once the sidewall 220 is fully retracted.

Figure 16C:
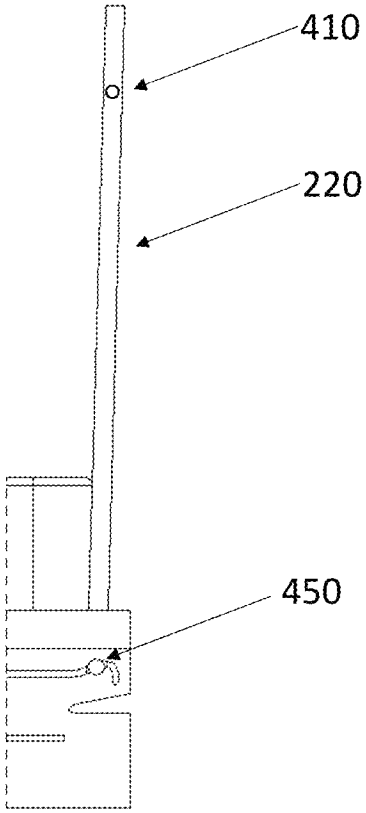
FIG. 16A-F shows a progression of the sidewall being retracted.
Figure 16B:
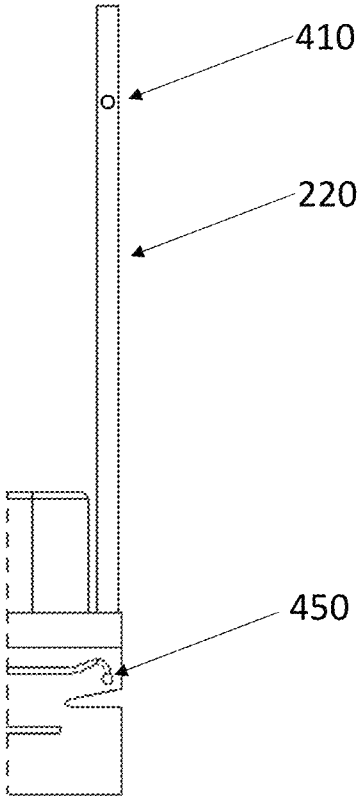
Figure 16A:
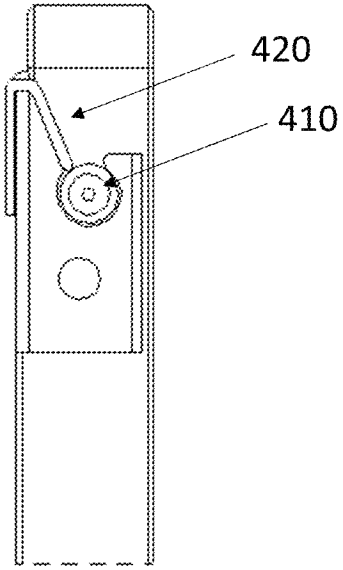
Figure 16F:
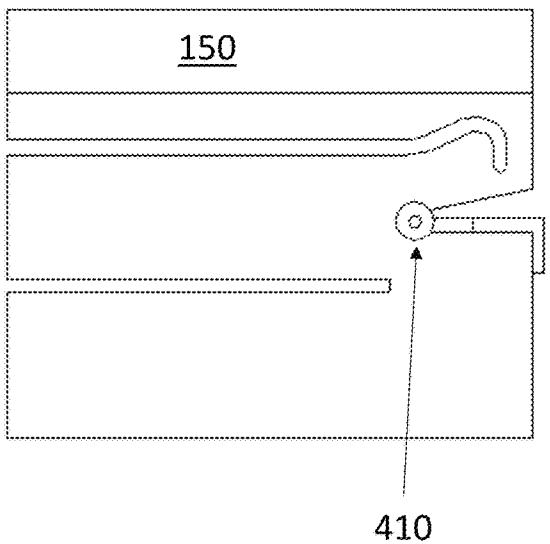
Figure 16E:
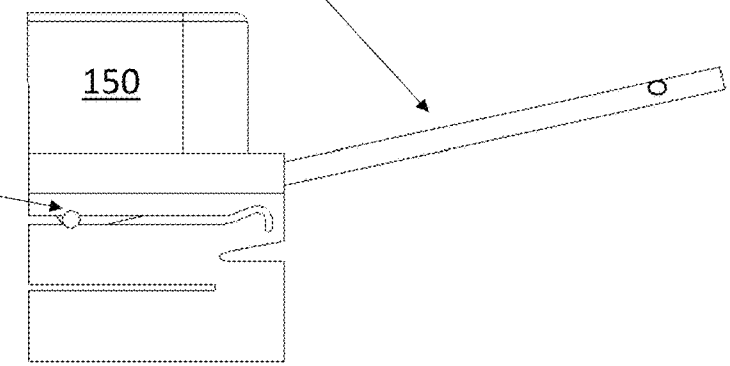
Figure 16D:
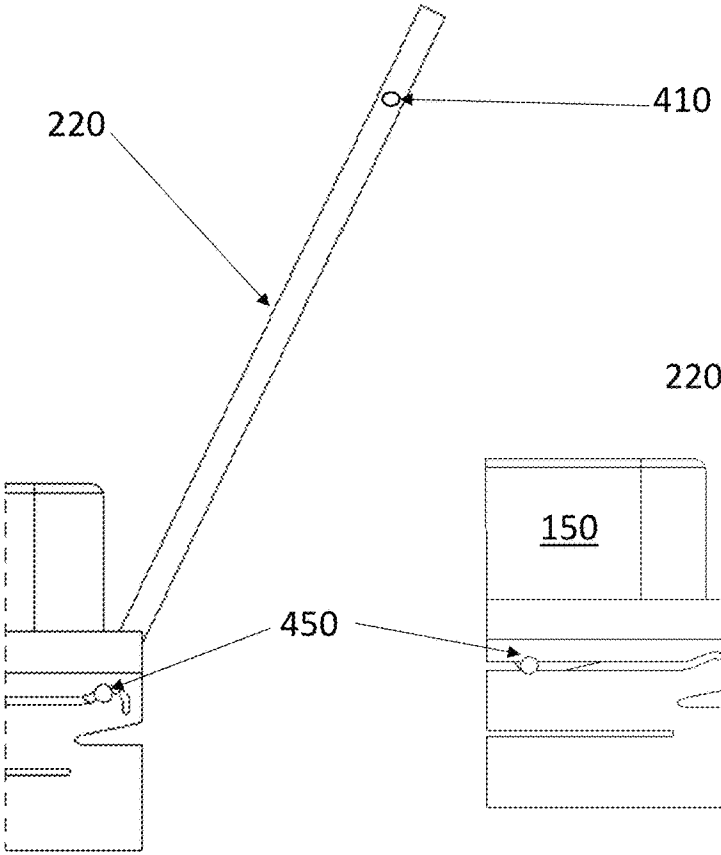

FIGS. 16A-16F shows the progression of the sidewall 220 from its upright/locked position, to its collapsed/stored position—and at multiple stages throughout that range of motion. In FIGS. 16A-16B, the sidewall is upright and latch 420 is engaged, with FIG. 16A focusing on the top of the bed/crib sidewalls showing secondary latch 420, and FIG. 16B shows the sidewall 220 upright with the bottom pin 450 positioned at the bottom of the J-shape slot. FIG. 16C shows the sidewall 220 being lifted with lower pin 450 rising out of the J-shape slot and traveling down the angled portion of the track 892, which cases sidewall 220 to begin pivoting/rotation outward away from base 150. FIG. 16D shows the sidewall 220 fully disengaged and partially rotated to be stowed. FIG. 16E shows the sidewall 220 almost fully retracted and nearly stowed under the base 150. FIG. 16F shows the sidewall 220 fully stowed and the pin 410 is in the retention slot on the proximal side of the bed/crib.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A convertible bed apparatus comprising:

a base;

a skirt comprising a plurality of lower sidewalls disposed below the base;

a plurality of sidewalls disposed above the base, and at least one moveable sidewall, the at least one movable sidewall having a first upright position, and a second retracted position disposed under at least a portion of the base;

wherein the at least one movable sidewall is displaced along a sliding track disposed in the skirt, the sliding track configured with a J-shape which includes a first portion aligned with the sliding track, a second portion oriented at an acute angle with respect to the first portion, and a third portion oriented vertically.

2. The convertible bed apparatus of claim 1, further comprising a first pin on the at least one movable sidewall that can be unlocked to allow the at least one movable sidewall to displace between the first and second positions.

3. The convertible bed apparatus of claim 2, wherein the first pin is disengaged by opening a latch.

4. The convertible bed apparatus of claim 2, wherein the first pin is retained in the latch due to gravity.

5. The convertible bed apparatus of claim 2, wherein the latch returns to a locked position after disengagement of the first pin.

6. The convertible bed apparatus of claim 2, wherein the first pin has a plurality of distinct diameters.

7. The convertible bed apparatus of claim 2, wherein the first pin disposed at a top of the at least one moveable sidewall and a latch disposed at a top of an adjacent sidewall.

8. The convertible bed apparatus of claim 6, further comprising a second pin disposed at a bottom of the at least one moveable sidewall.

9. The convertible bed apparatus of claim 8, wherein the second pin is disposed in a distal end of the sliding track when the at least one movable sidewall is in the second retracted position.

10. The convertible bed apparatus of claim 8, wherein the second pin is disposed in the third portion of the sliding track when the at least one movable sidewall is in the first upright position.

11. The convertible bed apparatus of claim 2, wherein the first pin is disposed below the J-shape portion of the sliding track when the at least one movable sidewall is in the second retracted position.

12. The convertible bed apparatus of claim 2, wherein the skirt includes a recess, the recess disposed below the J-shaped track and located on a side of the skirt that coincides with the at least one moveable wall.

13. The convertible bed apparatus of claim 12, wherein the first pin is received within the recess when the at least one movable sidewall is in the second retracted position.

14. The convertible bed apparatus of claim 1, wherein the at least one movable sidewall has a greater height than an adjacent sidewall.

15. The convertible bed apparatus of claim 1, wherein the at least one movable sidewall further comprises vertical slats disposed therein.

16. The convertible bed apparatus of claim 1, wherein the at least one movable sidewall comprises foldable slats configured to rotate downward when the at least one movable sidewall is in the second retracted position.

17. The convertible bed apparatus of claim 16, wherein the at least one movable sidewall is configured to be stable in an intermediary position wherein the foldable slats support the weight of the at least one movable sidewall while in the intermediary position partially under the base.

18. The convertible bed apparatus of claim 17, wherein the intermediary position is between the first upright position and the second retracted position.

19. The convertible bed apparatus of claim 1, wherein the base is configured to retain and support a mattress.

20. The convertible bed apparatus of claim 14, wherein the at least one movable sidewall is configured to create a stepping area when in the second retracted position.

* * * * *